US008348467B2

(12) United States Patent
Khan

(10) Patent No.: US 8,348,467 B2
(45) Date of Patent: Jan. 8, 2013

(54) LIGHT DISTRIBUTION USING TAPERED WAVEGUIDES IN LED-BASED TUBULAR LAMPS AS REPLACEMENTS OF LINEAR FLUORESCENT LAMPS

(76) Inventor: Mujibun Nisa Khan, Colts Neck, NJ (US)

( * ) Notice: Subject to any disclaimer, the term of this patent is extended or adjusted under 35 U.S.C. 154(b) by 0 days.

(21) Appl. No.: 13/135,303

(22) Filed: Jun. 30, 2011

(65) Prior Publication Data

US 2012/0002436 A1 Jan. 5, 2012

Related U.S. Application Data

(60) Provisional application No. 61/398,932, filed on Jul. 2, 2010.

(51) Int. Cl.
*F21V 33/00* (2006.01)

(52) U.S. Cl. ..... 362/254; 362/311.02

(58) Field of Classification Search ..... 362/254
See application file for complete search history.

(56) References Cited

U.S. PATENT DOCUMENTS

| | | | | |
|---|---|---|---|---|
| 6,874,924 | B1 * | 4/2005 | Hulse et al. | 362/551 |
| 7,021,809 | B2 * | 4/2006 | Iwasa et al. | 362/555 |
| 2005/0225979 | A1 * | 10/2005 | Robertson et al. | 362/240 |
| 2005/0276064 | A1 * | 12/2005 | Wu et al. | 362/555 |
| 2006/0028837 | A1 * | 2/2006 | Mrakovich | 362/602 |

* cited by examiner

*Primary Examiner* — Laura Tso

(57) ABSTRACT

An LED replacement-lamp design concept comprising tapered waveguides to provide uniform and broad light distribution is disclosed. Currently, most LED-based replacement lamps for tubular fluorescent lamps place discrete surface-mount LEDs directly on a cylindrical base, which produce wasteful, non-uniform and directional illumination unsuitable for large space and high-ceiling applications. An LED lamp design, proposed as a tubular lamp replacement, comprises of a plurality of discrete LEDs mounted on a common substrate, where all light from each LED is immediately guided and broadened through a tapered waveguide long enough to seamlessly terminate at the lamp's semi-circularly curved cover surface. Many such LED-waveguide assemblies can fill the entire curved cover with diffused and uniform light distribution, resulting in illumination over broad angular ranges. The proposed lamp has a "D" shaped cross-section wherein the lamp's flat side is used as a heat-sink base to be placed against the ceiling or some blocking surface.

12 Claims, 7 Drawing Sheets

LIGHT DISTRIBUTION USING TAPERED WAVEGUIDES IN LED-BASED TUBULAR LAMPS AS REPLACEMENTS OF LINEAR FLUORESCENT LAMPS

This application claims priority from Provisional Patent Application No. 61/398,932 files on Jul. 2, 2010.

BACKGROUND OF THE INVENTION

Field of the Invention

Today's energy challenge is the most pressing economic and political concern that is only exacerbating, everyday. The news media as well as global leaders' primary focus, for some time, has been revolving around issues addressing the energy and related environmental challenges; this became a haunting reality when BP's massive oil spill in the Gulf of Mexico occurred on Apr. 20, 2010, the recovery costs of which have mounted in the 10's of billions.

While the energy challenge encompasses many elements, it can be significantly overcome by reducing energy consumption and adopting energy-efficient solutions in such primary areas as transportation, heating and air conditioning, refrigeration, lighting, and media appliances such as TVs, computers, and alike. According to US DOE (Department of Energy), lighting accounts for over 20% of all energy usage, both domestically and globally. A significant part of this 20% is utilized towards industrial lighting.

A single most widely used lighting unit in a commercial building is the T8—the linear fluorescent light (LFL) of 1 inch tube diameter that is usually placed in the ceiling, in array clusters. They come in various lengths, ranging from 2 ft to 8 ft. Regular work offices typically use 4-ft T8's, while large stores and warehouses use 8-ft T12's. [T5, T8, and T12 are LFLs with ⅝'s, ⅜'s, and 12/8's inch diameters. The term "Tx" will be used in this patent application to refer to all 3 types of commonly used tubular lamps or LFLs, meaning T5, T8, T12, or any other diameter for T-type lamps.] Many cabinet signs also use these lighting units. Many installed luminaires with these lamps are old and have lower efficacies than those from newer available products and therefore is wasting a great deal of energy. [A luminaire is a lamp with fixtures.] Further, most old fluorescent lamps are not dimmable and hence end up wasting more energy when less light is desired due to variable ambient conditions. A recent DOE study revealed that 10's of millions of these fixtures are used everyday in the US alone, and therefore upgrading them to more efficient luminaires would offer tremendous energy savings. Although LEDs have been touted as the next-generation energy-efficient lighting solutions, the more-popular inorganic LEDs are small, planar light sources; therefore without any additional optical elements, they produce directional and concentrated light over small space and thus only suitable for target and task lighting, but not for broad space lighting.

Despite these shortcomings of current LEDs, several companies are currently producing LED-based tubular lamps by placing discrete LED modules directly on the tube surface to mimic LFLs. When one directly views these lamps along with traditional LFLs, they make look similar at a glance when they are both lit; however, their illumination capabilities are very different. This is because LEDs are flat or planar devices that produce light mostly directly in front of the source—which is generally described as substantially directional light distribution; further, in the current LED tubular replacement lamps, small and singular LED packaged modules are discretely arranged leaving at least 50% of the tubular surface void of light sources and hence at least 50% of the surface remains dark. [Note that today's packaged LED modules have light sources or emitting areas in the middle of the board or substrate that roughly covers only 50% of the surface area while the other 50% consists of packaging components such as lens and electrical components and others.] This 50% surface darkness along with directional light from of the LEDs themselves form a very different light distribution compared to that from a regular LFL. A LFL distributes light uniformly in all radial directions outward, all around the tube circumference and length. The result is that large rooms or spaces can be more uniformly and brightly illuminated with LFL arrays in clusters, placed in the ceiling.

This invention provides a design concept to make LED-based replacement lamps equivalent to LFLs in terms of light distribution while being superior to LFLs in terms of energy efficiency and compactness. The concept uses the currently prevalent inorganic LEDs that are small and planar, but along with tapered waveguides to broaden their light output at the surface of the LED luminaire and to eliminate any dark spots on the surface. The design incorporates a semi-circle cross section, i.e., half a cylindrical tube that results in a flat surface on one side that does not illuminate. Since these lamps are usually placed against a ceiling, it only needs to illuminate from one side that is below the ceiling. The flat side goes against the ceiling, which makes it suitable for placing a heat sink to provide good thermal management that LEDs require to operate efficiently over a long lifetime.

More specifically this invention relates to constructing an LED replacement lamp for tubular lamps or LFLs that use discrete LEDs along with tapered waveguides to produce uniform light over large spaces.

All design concepts described here can also be applied to organic LED (OLED) light sources where OLEDs usually have larger chip sizes than conventional LEDs; the advantage of OLEDs may be that they can be quite large area devices or modules, thus allowing manufacturers to produce significantly large luminaires that may be appropriate for warehouses and other commercial buildings.

Currently most LED-based replacement lamps for LFLs use discrete surface-mount (SMT) LED modules directly on the tubular surface as shown in FIG. 1. This leaves approximately 50% of the tubular surface dark. Further, LED modules produce only directional light output and therefore the combined result is that these lamps produce very non-uniform light that is not suitable for illuminating large home, office, or warehouse space. This invention offers designs that will produce LED-based lamps that have no dark-spots on the illuminating surface and can match or outperform the light distribution quality from LFLs for large space illumination applications, while offering high energy efficiency that LED-based lamps have been known to promise based on their potential.

A study by US DOE reported in June 2010 shows that current LED-based T8s from many manufactures only put out half the lumens compared to their LFL counterparts even in the best case.[1] This is consistent with the explanation of this disclosure that arranging discrete SMT LED modules directly on the tubular surface leaves at least 50% of the lamp surface dark, thus reducing the total light output capacity by approximately 50% from their LFL counterparts when LEDs and LFLs both have efficacy per unit area in the same ballpark. Since illumination is not only about matching total lumen output, using two such LED-based replacement lamps to replace one LFL would not be equivalent either in terms of uniform and broad area illumination. The illumination problem with respect to uniformity would still remain for such LED replacement lamps even if the efficacy of LED-based lamps is doubled or further increased in the future.

Most LFLs are usually placed against the ceiling to illuminate large rooms and therefore the light need not be directed towards the ceiling because illumination is typically desired in the space, below the ceiling. However, manufacturers would be greatly challenged if they were to cost effectively make LFLs that were not tubular or cylindrical, but had the shape of half a cylinder with a flat top. To overcome the loss of light in the upward direction from the ceiling, the LFL luminaires are constructed as recessed in the ceiling with reflectors to point all the light downward from the ceiling, as shown in FIG. 2. But an LED-based luminaire need not mimic the LFL for such illumination applications because LEDs are small discrete devices that do not require any tubular or cylindrical construction to produce light. Therefore, half a cylinder with a flat top lamp shape would illuminate areas below the ceiling effectively without the need for a recessed design with reflectors.

This design would allow a suitable heat-sink to be placed on the flat side that would be recessed in the ceiling so that heat dissipation from the back of the LEDs can be achieved.

The LED-based LFL-replacement designs proposed here are shown in FIGS. 3 through 6. The designs will allow the usage of LED chips or modules on a board which will send light through tapered waveguides that will bring the light at the illuminating surface of the lamp seamlessly without creating any dark spots on it. The design concepts here provide substantially more uniform illumination compared to today's LED-based replacement lamps while providing better thermal management schemes via the usage of large-scale heat sinks.

SUMMARY OF THE INVENTION

Because LED technologies have demonstrated significantly improved efficacies, light output and color quality in the last few years, many solid-state lighting (SSL) or LED manufacturers are convinced that LED-based, Tx-equivalent luminaires are ready to outperform their LFL counterparts. The contention stems from the fact that white, high-brightness LEDs, or HB-LEDs can now produce the same (or higher) efficacies as LFLs do, thus, a Tx-equivalent constructed with simply surface-mounted LEDs without further conditioning for light distribution will easily match or outperform any of its LFL counterparts.

This disclosure states that the above concept is invalid and offers new LED, replacement lamp designs that can outperform current LFLs. A report by the DOE Commercially Available LED Product Evaluation and Reporting (CALiPER) program, which supports testing various SSL products available for general illumination, confirms that the LED-based tubular lamps manufactured in 2010 do not put out as much light as their LFL counterparts and that the light distribution is not comparable with that from LED-based lamps. This is true even with 2010 single LED modules that have higher efficacies than LFLs.

Current or prior-art LED lamps are well suited to replace such small area illumination applications as retail, display, refrigeration, and task lighting. However, warehouses, large stores, and office buildings are better served with fluorescent lights, from both cost and energy savings perspectives. This can change if designs from this disclosure are applied to produce LED-based LFL replacements.

In order for LED lamps to illuminate large spaces, individual LED light sources must be very densely and seamlessly arranged around a Tx tube—which is currently not possible with rigid, flat-backed, surface-mount technology (SMT) LED lamps that have a crowned, lamp device as the light source. A SMT LED has the LED chip, which is the light source, mounted typically in the middle of the board at the bottom, taking up only about 70% off the board surface and leaving the other 30% for packaging material and handling. Such an LED-based Tx construction would produce considerably less light than the LFLs, if the lumen per square meter were similar because a significant portion, i.e., approximately 50% of the LED Tx surface would remain dark when it is lit.

Even with a denser arrangement of LED chips or SMT LEDs on a Tx, than currently possible, the LED-sourced illumination wouldn't be as broad or uniform as a standard Tx, because current LED lamps output light directionally from the flat surface.

To construct a 4-ft LED T8 equivalent lamp for example, the experimenting engineers must pack multiple, SMT LEDs into a 4 ft. long, 1-in, diameter tube. Using current LED technology, this experiment, at best, would produce a 50% duty cycle for, the spatial light sources and leave the other 50% dark. The measurable light that emits from such an LED-based T8 would be limited to half the optical power of a conventional T8 with similar unit-area brightness, because, the LFL produces fairly continuous light (almost 100% duty cycle) all along the tube length and in all 360° angles uniformly from the tube surface. An LED-based T8 wouldn't illuminate, as uniformly in all such directions. Further, the illumination would be confined to a contracted region because light emanating from each discrete LED is directional (narrow), which makes such a system unsuitable for illuminating such large 3-dimensional spaces as stores, shops and warehouses.

Some argue that when the unit area brightness or luminance is increased, meaning, when individual LEDs produce more lumens and candela per square area without further increase in drive current, the LED Tx's light output will be the same or more than that of the LFL Tx's. This may be true when only the total light output is compared from an integrated sphere or with goniophotometer measurements; however, the uniformity of the light distribution from LED Tx's will remain much less and each exposed LED will appear too bright for the naked eye. Such high brightness may not be good for the human eye and it would not be surprising if someday it is rated hazardous for viewing. Using a translucent cover on top will only reduce the luminaire efficiency and lessen the energy efficiency argument for LED Tx's and thus will not be an effective solution.

This disclosure offers several LED-based lamp design concepts for replacing LFLs that promise to generate brighter, more uniform, more efficient, dimmable, and longer-lasting lamps and luminaires compared to current fluorescent-based LFLs.

The design elements of this invention also offer better thermal management of LEDs and subsequently longer lifespan for LED lamps and luminaires. This design concept can be extended to organic LEDs.

According to the invention, the proposed LED replacement lamp configuration using current LED chips and tapered waveguides provide the following:

a. Substantially more uniform illumination compared to existing LED replacement lamps and luminaires for LFLs and Tx's in particular.
b. Substantially more omni-directional light distribution by utilizing tapered waveguides, also known as "light-pipes" along with LED chips or packaged modules as discrete light sources.

c. Illumination over a broad-area or a large-space since tapered waveguides uniformly diffuse the concentrated light from small, discrete areas to a large area, over a flat or curved lamp surface, as desired.

d. The illuminating lamp surface is void of dark spots because the tapered waveguides seamlessly bring uniformly distributed diffused light from the LED light sources to the lamp surface.

e. Tapered-waveguide based LED Tx's provide the same uniform and wide-area illumination as fluorescent Tx's using only half a cylinder, in other words a D-shaped cross-section as opposed to a circular cross-section in conventional Tx's. The proposed LED Tx in this disclosure is thus more compact and efficient, and does not need reflectors to direct light away from the ceiling.

f. The proposed LED Tx configuration can make use of the non-illuminating back side that is flat to place a large heat-sink that can be inserted into the ceiling for hide-away, which will provide for efficient heat management of the LED modules in the Tx ensemble.

g. The usage of a suitable, large heat sink leads to reduction in LED drive current requirements and therefore improves LED luminaire lifetime.

This LED modules used in the configurations of this invention may be white or a single-color (e.g., red, blue, green, etc.) light sources. The LED modules discussed in this invention may be made using inorganic or organic semiconductors. The organic semiconductor LEDs are also known as OLEDs.

BRIEF DESCRIPTION OF THE DRAWINGS

FIG. 4(*b*) shows the enlargement of the cut "end" of FIG. 4(*a*), showing the details of the LED-waveguide ensemble. The direction of light emanating from the lamp cover (which may be a lens) is shown in this figure.

DETAILED DESCRIPTION OF PREFERRED EMBODIMENTS

Figure 1:
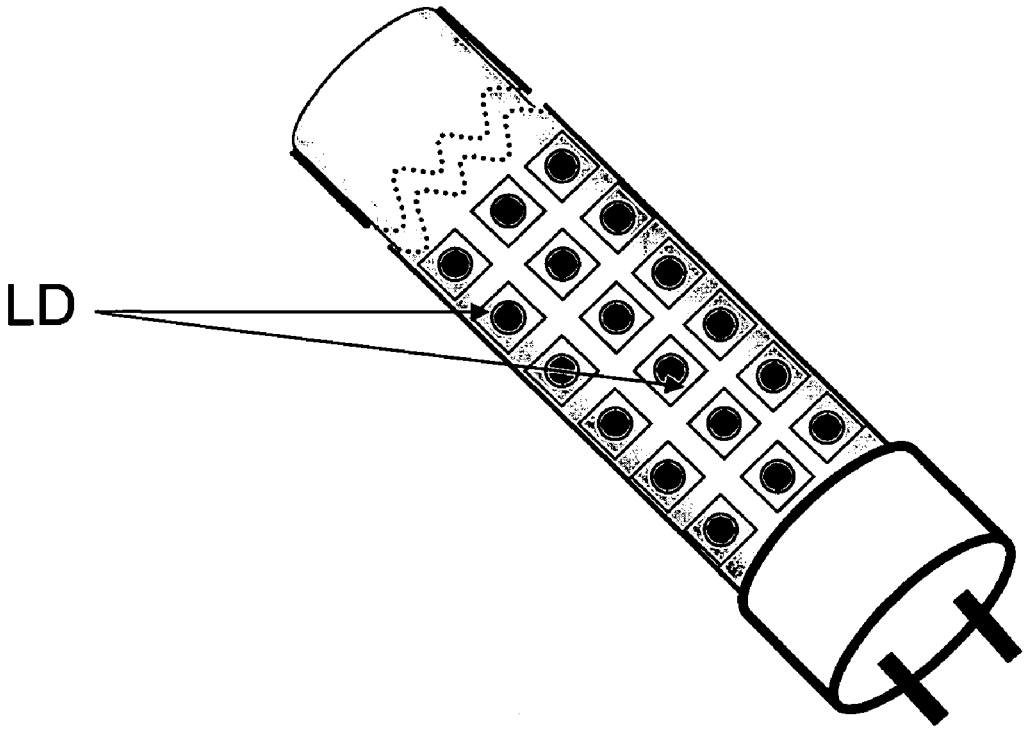
FIG. 1 shows a schematic of a current commercial LED replacement lamp for tubular or linear fluorescent lamps (LFLs) that place LED sources directly on the lamp surface.

FIG. 1: FIG. 1 shows a schematic of a current (prior art) commercial LED replacement lamp for tubular or linear fluorescent lamps (LFLs) that place discrete LED sources (LD) directly on the lamp surface. The schematic is drawn from an example of prior art which is the MK1 LED-based T8 from a company called Illumisys. Here the discrete LED modules are directly placed on the tubular lamp to mimic a T8-LFL.

Figure 2:
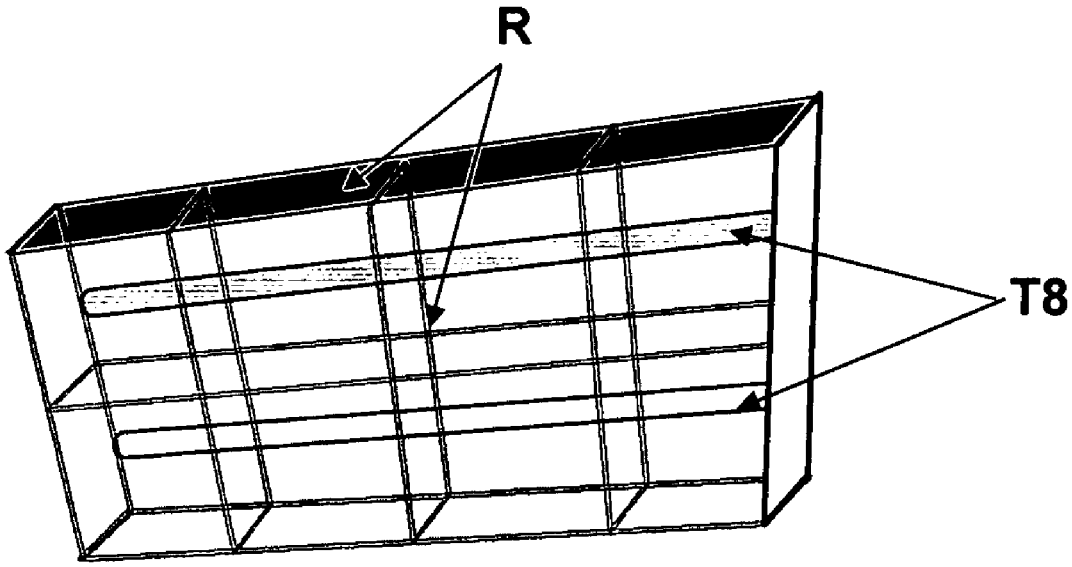
FIG. 2 shows a schematic of a commercial LFL luminaire system placed in a ceiling of an office building.

FIG. 2: FIG. 2 shows a schematic of a commercial T8-LFL luminaire system placed in a ceiling of an office building. Conical reflectors (R) are used above these T8s to direct most of the light downward and away from the ceiling. A grid is placed below the lamps to protect the glass lamps from possible accidents.

Figure 3:
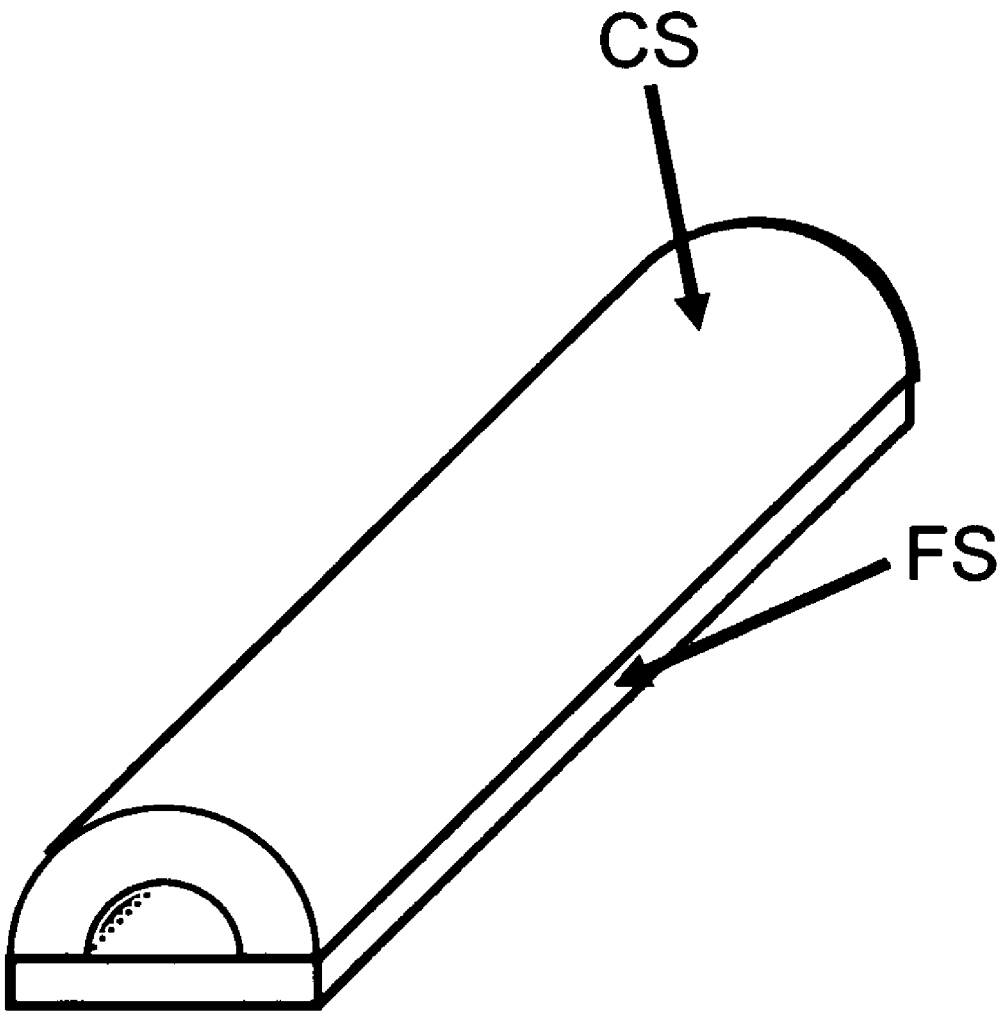
FIG. 3 shows the enclosed external structure of the proposed LED replacement lamp for LFLs.

FIG. 3: FIG. 3 shows the enclosed external structure of the proposed LED replacement lamp for LFLs. The lamp is semi-circular with a flat surface (FS) on one side. The light exits the lamp from the curved surface (CS). The flat side goes against the ceiling and need not illuminate since illumination is only needed below the ceiling.

Figure 4A:
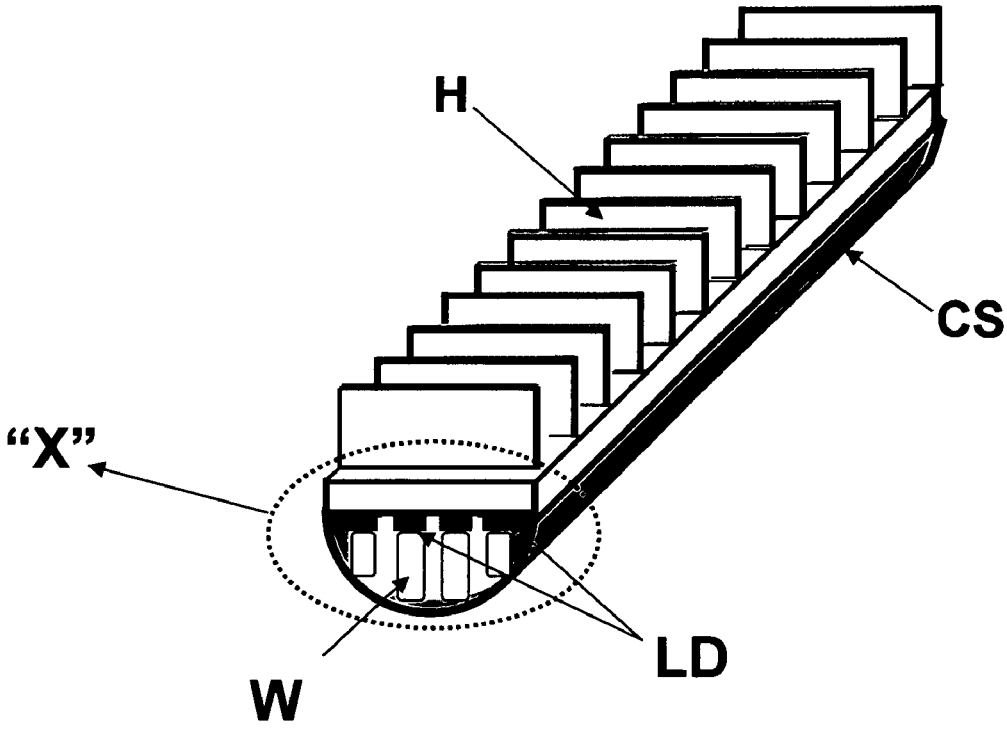
FIG. 4(*a*) shows the proposed LED-replacement lamp cut along its length on one "end" to show the LED-waveguide ensemble inside. The discrete LED modules (or chips) are shown as arrays and the attached waveguides to these LEDs are shown to extend to the lamp surface. In this figure, the proposed lamp shows the heat sink on the flat side.
Figure 4B:
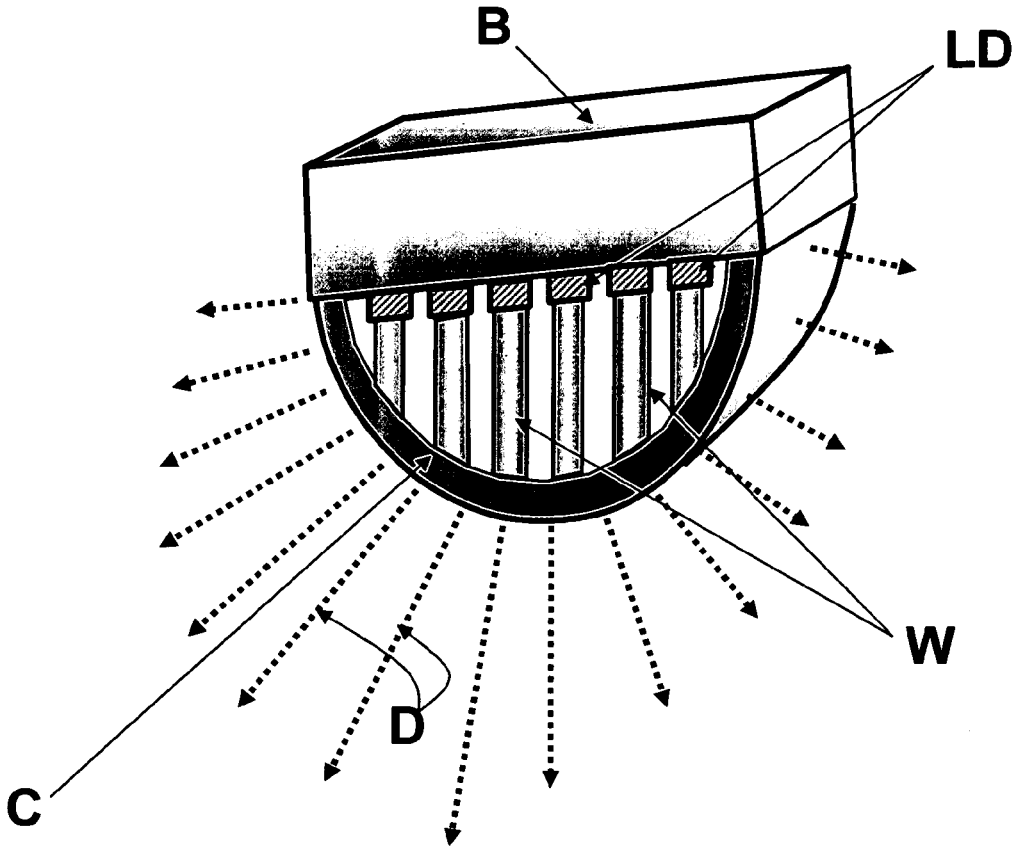

FIG. 4(*a*): FIG. 4(*a*) shows the proposed LED-replacement lamp cut along its length on one "end" to show the LED-waveguide ensemble inside. The cross-section of this cut end is denoted with "X". The discrete LED modules (LD) (or chips) are shown as arrays and the attached waveguides (W) to these LEDs are shown to extend to the lamp cover, surface (CS). In this figure, the proposed lamp shows the heat sink (H) with fins on the flat side. The waveguide taper details are not shown here for simplicity purposes.

FIG. 4(*b*): FIG. 4(*b*) shows the enlargement of the cut "end" (i.e., "X") of FIG. 4(*a*), showing the details of the LED-waveguide ensemble. The LEDs are denoted as "LD", placed on Base-Board (B) and waveguides are denoted as "W" do, not show the taper details for simplicity purposes. The proposed LED replacement lamp here shows the light distribution pattern "D" with dotted arrows from the lamp surface or cover "C".

Figure 5:
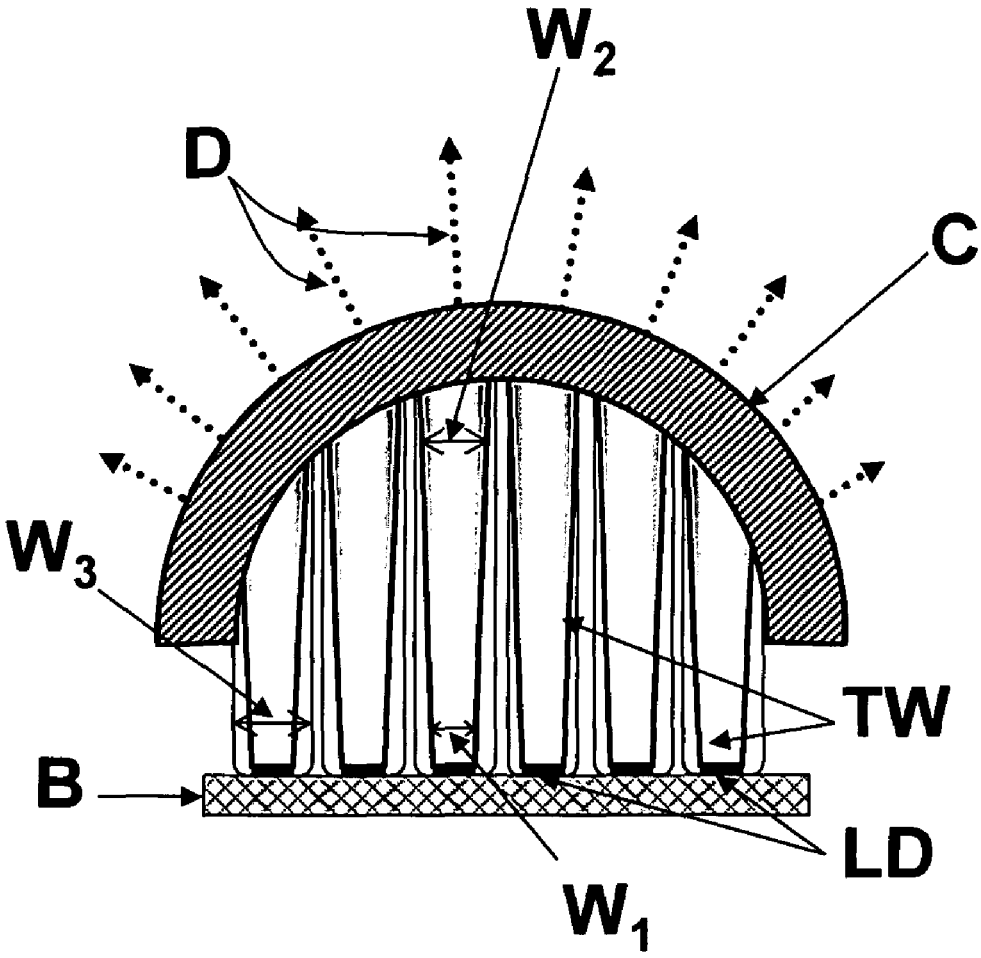
FIG. 5 shows the enlargement of the proposed lamp cross-section showing the discrete LEDs and the tapered waveguides, which produces uniform light distribution in radial directions.

FIG. 5: FIG. 5 shows the enlargement of the proposed lamp's two-dimensional cross-section showing the LEDs, denoted as "LD" on base-board "B", connecting the tapered waveguides (TW). The details of the tapered waveguides (TW) are shown here with two different taper widths, $W_1$ and $W_2$ for the core or guiding region. The tapered waveguide core width $W_1$ is closer to the LED and hence is smaller than the tapered waveguide core width $W_2$ that is closer to the lamp's cover. The tapered waveguide cladding has width $W_3$. The uniform light distribution "D" (shown in dotted line arrows) is produced in radial directions from lamp cover denoted as "C", providing illumination over broad angular ranges.

Figure 6:
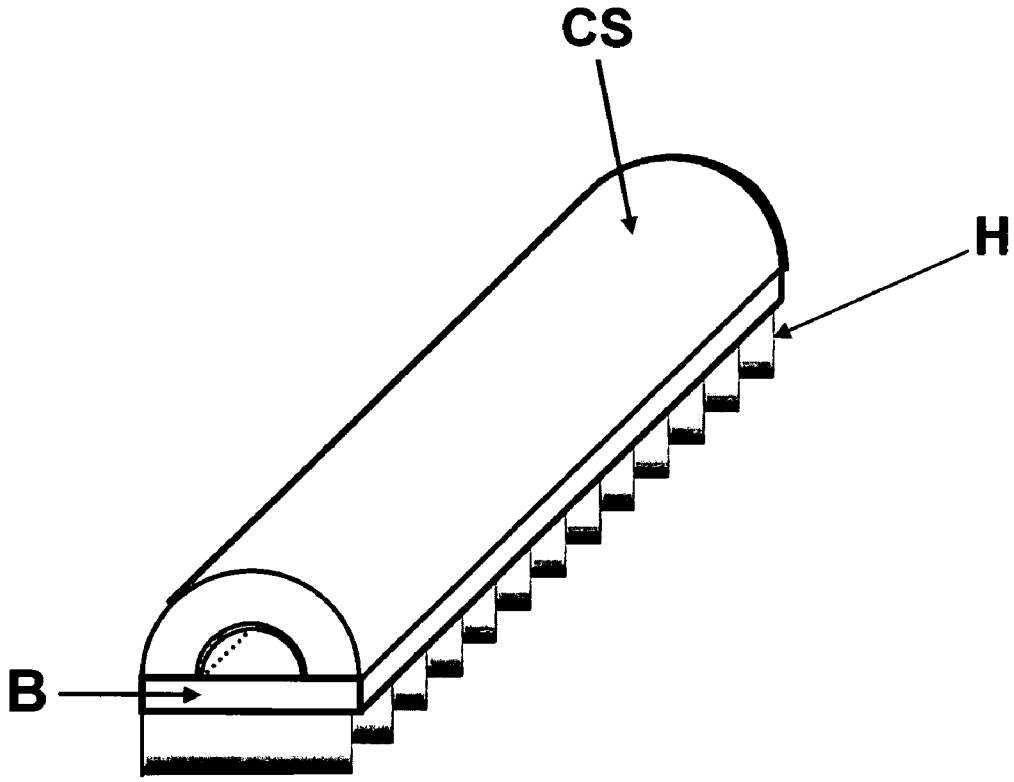
FIG. 6 shows, the complete proposed LED-based replacement lamp that may be built to replace any tubular lamp, in particular those that goes against the ceiling.

FIG. 6: FIG. 6 shows the complete proposed LED-based replacement lamp that may be built to replace any tubular lamp, in particular those that goes against the ceiling. Here H is the heat sink, B is the base-board which is a flat surface, and CS is the semi-circular curved surface.

In this invention disclosure, I, M. Nisa Khan, claim the patent ownership of the following:

1. An LED replacement lamp for replacing a tubular or linear fluorescent light comprising:

(a) a base board;

(b) a plurality of LEDs mounted on the base board;

(c) a plurality of optical waveguides, having an incident surface and an exit surface; wherein each of the LEDs has a corresponding waveguide and all the light emitted from each of the LEDs immediately enters the corresponding waveguide's incident surface, after which it is guided through the waveguide core and then exits at the exit surface;

(d) a cover which accepts the light exiting the exit surfaces of the plurality of waveguides wherein the waveguides have an adiabatic or slowly varying increase in their core or light-guiding region's cross-sectional area as the distance from the LED increases which allows diffusion or broadening of light from each LED source at the cover's surface.

2. An LED replacement lamp according to claim 1, wherein the cover is curved, so as to distribute light uniformly in space over broad angular ranges.

3. An LED replacement lamp according to claim 2, wherein the lamp's curved cover and the base board produces a semi-circular cross-section similar to the shape of the letter "D".

4. An LED replacement lamp according to claim 1 or 3, wherein the lamp configuration has a flat side that may be placed against the ceiling or some blocked surface.

5. An LED replacement lamp according to claim 1 or 3, wherein the flat side of the lamp may be used as a base for heat sink and the heat-sink may be embedded into the ceiling or some blocked structure so that it will not be visible from the living space below the ceiling where the LED lamp provides illumination.

6. An LED replacement lamp according to claim 1, wherein the plurality of waveguides comprise tapered waveguides having of either increasing cross-sectional area.

7. An LED replacement lamp according to claim 1, wherein the plurality of waveguides comprises a single mode waveguide.

8. An LED replacement lamp according to claim 1, wherein each of the tapered waveguide's exit surface terminates seamlessly with appropriate shaping at the lamp's curved cover so as to avoid any dark spots on the lamp's cover surface.

9. An LED replacement lamp according to claim 1, wherein the plurality of waveguides comprises a multimode waveguide.

10. An LED replacement lamp according to claim 1, wherein the plurality of waveguides comprise waveguides having non-varying cross-sectional area.

11. An LED replacement lamp according to claim 1, wherein the plurality of waveguides comprise waveguides having variable lengths.

12. An LED replacement lamp according to claim 1, wherein the plurality of waveguides comprise waveguides having core and cladding parts and wherein the waveguides have variable bend radii for both core and cladding parts of the waveguides.

* * * * *